US010882162B2

(12) United States Patent
Kukucka et al.

(10) Patent No.: US 10,882,162 B2
(45) Date of Patent: Jan. 5, 2021

(54) SPHERICAL ANTI-SLIP FASTENER REMOVER

(71) Applicant: Grip Tooling Technologies LLC, Brandon, FL (US)

(72) Inventors: Paul Kukucka, Brandon, FL (US); Thomas Stefan Kukucka, Brandon, FL (US)

(73) Assignee: GRIP TOOLING TECHNOLOGIES LLC, Brandon, FL (US)

( * ) Notice: Subject to any disclaimer, the term of this patent is extended or adjusted under 35 U.S.C. 154(b) by 306 days.

(21) Appl. No.: 15/882,787

(22) Filed: Jan. 29, 2018

(65) Prior Publication Data

US 2018/0147698 A1 May 31, 2018

Related U.S. Application Data

(63) Continuation-in-part of application No. 15/650,768, filed on Jul. 14, 2017, now Pat. No. 10,081,094, and a continuation-in-part of application No. 15/601,864, filed on May 22, 2017, now abandoned, and a continuation-in-part of application No. 29/604,799, filed on May 19, 2017, now Pat. No. Des. 829,069, and a continuation-in-part of application No.

(Continued)

(51) Int. Cl.

| | |
|---|---|
| ***B25B 13/06*** | (2006.01) |
| ***B25B 23/10*** | (2006.01) |
| ***B25B 23/00*** | (2006.01) |
| ***B25C 11/00*** | (2006.01) |
| ***B25B 15/00*** | (2006.01) |
| *B25G 1/06* | (2006.01) |

(52) U.S. Cl.

CPC ..... *B25B 13/065* (2013.01); *B25B 15/004* (2013.01); *B25B 23/0035* (2013.01); *B25B 23/105* (2013.01); *B25C 11/00* (2013.01); *B25G 1/066* (2013.01)

(58) Field of Classification Search

None

See application file for complete search history.

(56) References Cited

U.S. PATENT DOCUMENTS 5,251,521 A * 10/1993 Burda ..... B25B 15/008 81/436

6,761,089 B2 * 7/2004 Bergamo ..... B25B 27/18 81/441

(Continued)

*Primary Examiner* — Brian D Keller

(57) ABSTRACT

A screw bit body which allows for efficient torque force application onto a socket fastener from a variety of angles. The screw bit body includes a plurality of laterally-bracing sidewalls, a first base, and a second base. The laterally-bracing sidewalls are radially distributed about a rotation axis of the screw bit body with each further including a first lateral edge, a second lateral edge, a concave surface, a convex surface, and an engagement cavity. The convex surface is adjacent to the first base and the concave surface is adjacent to the second base to create a ball-like shape. The engagement cavity creates a gripping point to prevent slippage in between the screw bit body and the socket fastener. The engagement cavity traverses normal and into the concave surface and the convex surface. Additionally, the engagement cavity traverses into the screw bit body from the first base to the second base.

6 Claims, 7 Drawing Sheets

Related U.S. Application Data

PCT/IB2017/052453, filed on Apr. 27, 2017, and a continuation-in-part of application No. 29/592,608, filed on Jan. 31, 2017, now abandoned, and a continuation-in-part of application No. 15/278,845, filed on Sep. 28, 2016, now Pat. No. 9,687,968, and a continuation-in-part of application No. 14/701,482, filed on Apr. 30, 2015, now abandoned.

(60) Provisional application No. 62/531,828, filed on Jul. 12, 2017, provisional application No. 62/482,916, filed on Apr. 7, 2017, provisional application No. 62/475,757, filed on Mar. 23, 2017, provisional application No. 62/459,371, filed on Feb. 15, 2017, provisional application No. 62/451,491, filed on Jan. 27, 2017, provisional application No. 62/328,102, filed on Apr. 27, 2016, provisional application No. 61/986,327, filed on Apr. 30, 2014.

(56) References Cited

U.S. PATENT DOCUMENTS

| | | | | |
|---|---|---|---|---|
| 7,331,260 | B2 * | 2/2008 | Cheng | B25B 13/04 81/119 |
| 9,687,968 | B2 | 6/2017 | Doroslovac et al. | |
| 2013/0047798 | A1 * | 2/2013 | Huang | B25B 13/481 81/461 |

* cited by examiner

SPHERICAL ANTI-SLIP FASTENER REMOVER

The current application claims a priority to the U.S. Provisional Patent application Ser. No. 62/451,491 filed on Jan. 27, 2017.

FIELD OF THE INVENTION

The present invention relates generally to tools designed for tightening or loosening fasteners, in particular bolts and nuts. More specifically, the present invention is an anti-slip bit ball-shaped bit designed to extract and tighten bolts, nuts, and other similar fasteners.

BACKGROUND OF THE INVENTION

Hex bolts, nuts, screws, and other similar threaded devices are used to secure and hold multiple parts together by being engaged to a complimentary thread, known as a female thread. The general structure of these types of fasteners is a cylindrical shaft with an external thread and a head at one end of the shaft. The external thread engages a complimentary female thread tapped into a hole or a nut and secures the fastener in place, binding the associated components together. The head is the means by which the fastener is turned, or driven, into the female threading. The head is shaped specifically to allow an external tool like a screwdriver to apply a torque to the fastener in order to rotate the fastener and engage the complimentary female threading to a certain degree. This type of fastener is simple, extremely effective, cheap, and highly popular in modern construction.

One of the most common problems in using these types of fasteners is the torque-tool slipping in the head portion during tightening or loosening of the fastener. This is generally caused by either a worn fastener or tool, corrosion, overtightening, and damage to the head portion of the fastener. The present invention is a torque bit design that virtually eliminates slippage. The design uses a bevel edge design that bites into the head of the fastener and allows for torque to be applied to the fastener in order to tighten or loosen it. Additionally, the present invention is a ball driver bit that allows for the torque tool to be partially angled relative to the rotation axis of the fastener. This permits tightening and loosening of fasteners in hard to reach environments without slippage. Furthermore, the present invention eliminates the need for the common bolt extractors as they require unnecessary drilling and tools.

DETAIL DESCRIPTIONS OF THE INVENTION

All illustrations of the drawings are for the purpose of describing selected versions of the present invention and are not intended to limit the scope of the present invention.

The present invention generally related to torque tool accessories. More specifically, the present invention is a multi-grip socket bit, also known as a screw bit or driver. The present invention allows for a higher torque to be applied to a socket fastener than a similarly sized conventional driver bit without damaging the head of the socket fastener or the bit tool. This is achieved through the use of a multitude of engagement features which effectively grip the head of the socket fastener. The present invention is a socket bit that is compatible with a variety of torque tools including, but not limited to, traditional drills, bit-receiving screwdrivers, socket wrenches, and socket drivers. Additionally, the present invention is implemented as a socket ball driver bit, thus allowing for engagement with a socket fastener at an angle for hard to reach areas.

Figure 1:
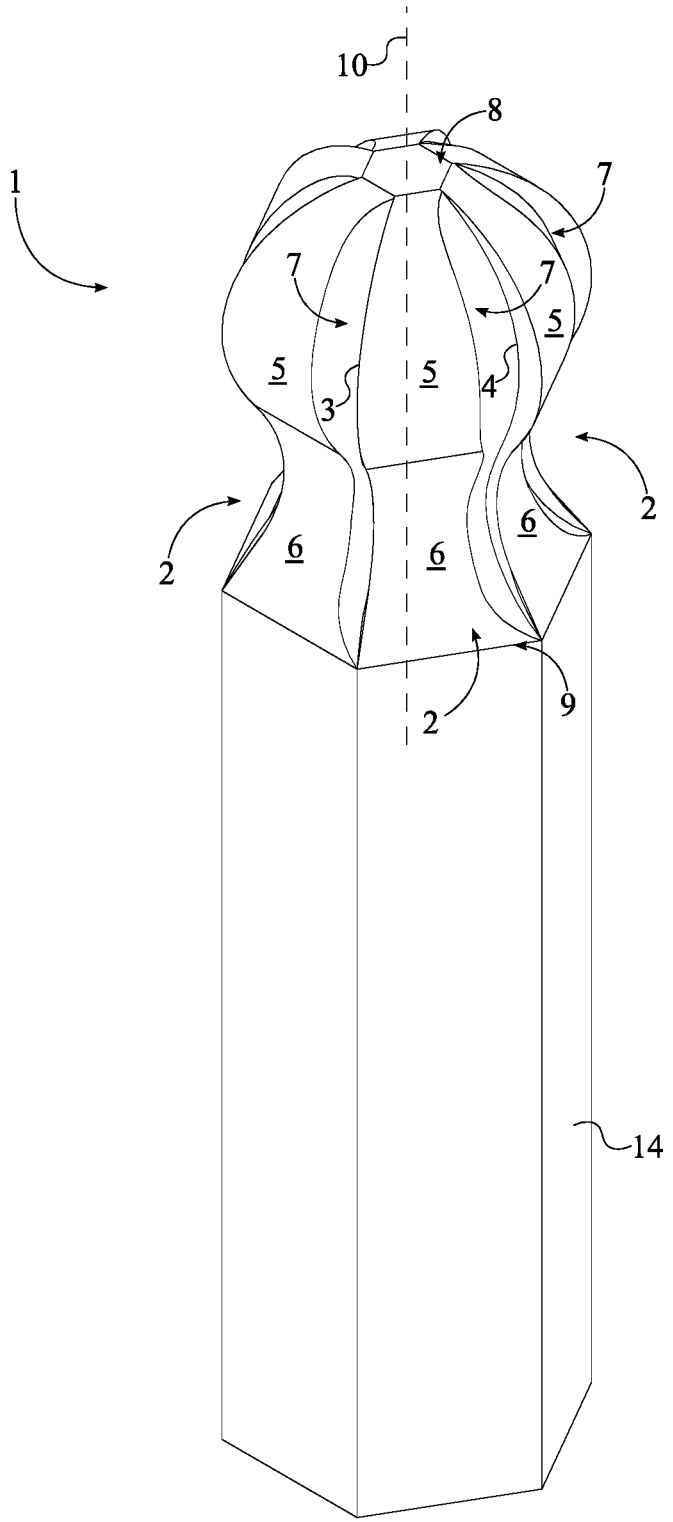
FIG. 1 is a perspective view of the present invention.

In its simplest embodiment, referring to FIG. 1, the present invention comprises an at least one screw bit body 1. The screw bit body 1 is a shank which engages the socket fastener, such as a socket screw or a socket bolt, in order to apply a torque force onto the socket faster. The screw bit body 1 comprises a plurality of laterally-bracing sidewalls 2, a first base 8, and a second base 9. In general, the screw bit body 1 is a ball-shaped prism composed of a strong metal. Each of the plurality of laterally-bracing sidewalls 2 engage within and grip the socket fastener in order to efficiently transfer torque from a torque tool to the socket fastener. The first base 8 and the second base 9 are positioned opposite to each other along the plurality of laterally-bracing sidewalls 2. Additionally, the first base 8 and the second base 9 are oriented perpendicular to each of the laterally-bracing sidewalls and thus enclose/complete the prism shape of the screw bit body 1.

Figure 4:
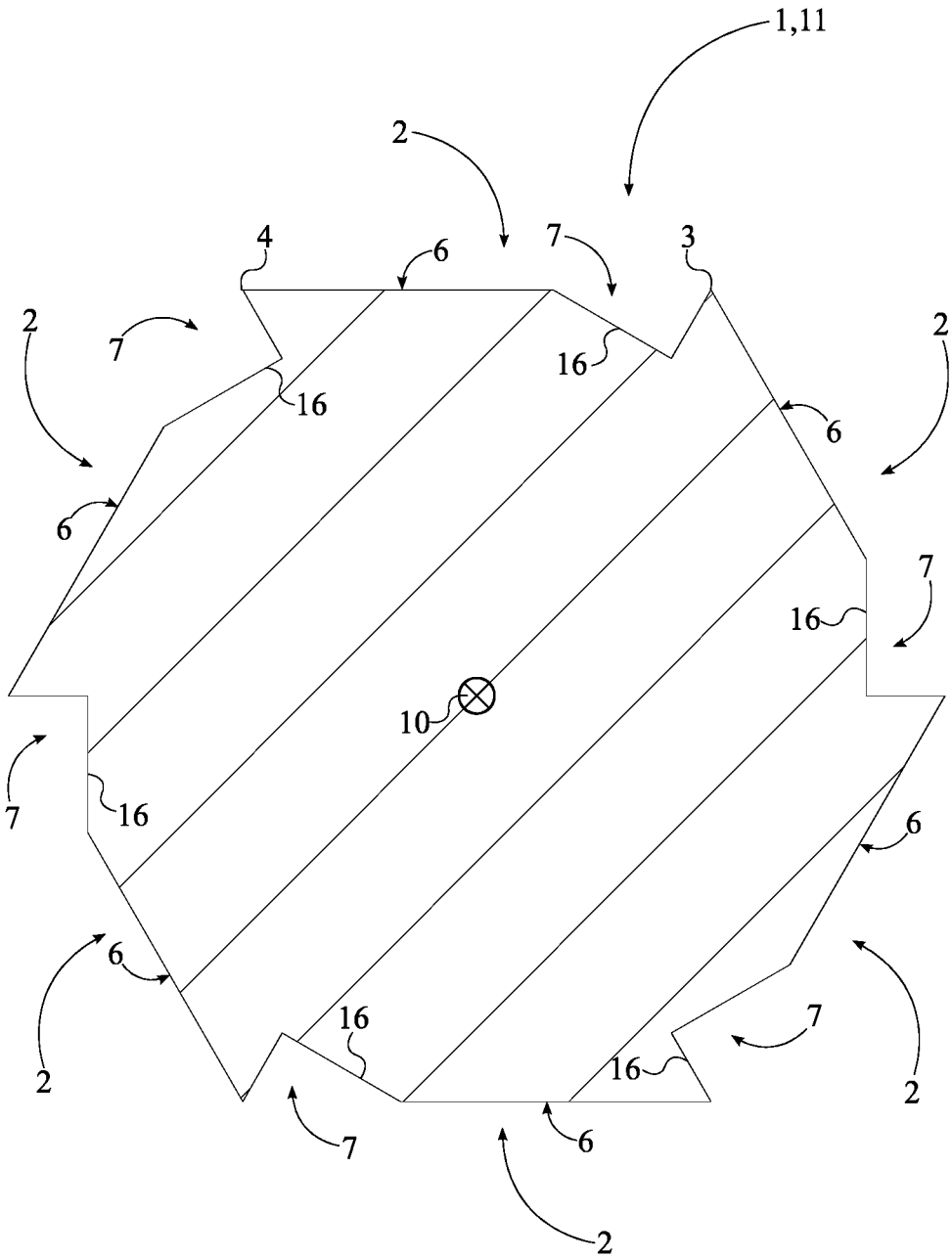
FIG. 4 is a cross-sectional view taken about line A-A in FIG. 3.

Referring to FIG. 1 and FIG. 4, each of the laterally-bracing sidewalls comprises a first lateral edge 3, a second lateral edge 4, a convex surface 5, a concave surface 6, and an engagement cavity 7. The plurality of laterally-bracing sidewalls 2 is radially positioned about a rotation axis 10 of the screw bit body 1 in order to yield a geometric profile complimentary to that of the socket fastener. The number within the plurality of laterally-bracing sidewalls 2 is subject to change to compliment the shape and profile of a variety of socket fasteners. In one embodiment of the present invention, the number within the plurality of laterally-bracing sidewalls 2 is six and the resulting geometric profile of the screw bit body 1 is a hexagon cross-section. In an alternative embodiment of the present invention, the number within the plurality of laterally-bracing sidewall is four and the resulting geometric profile of the screw bit body 1 is a square cross-section.

The convex surface 5 and the concave surface 6 make a bracing face that physically presses against the socket fastener, in particular the lateral sidewall of a head portion from the socket fastener. More specifically, the convex surface 5 and the concave surface 6 delineate a curved surface such that the plurality of laterally-bracing sidewalls 2 form a ball-like shape. The convex surface 5 is positioned adjacent to the first base 8 such that the convex surface 5 from each of the plurality of laterally-bracing sidewalls 2 forms the body of the ball-like shape. The concave surface 6 is positioned adjacent to the convex surface 5, opposite to the first base 8 such that the concave surface 6 from each of the plurality of laterally-bracing sidewalls 2 further forms the ball-like shape and provides clearance for when the screw bit body 1 is engaged to the socket fastener at an angle. The convex surface 5 and the concave surface 6 are oriented along the rotation axis 10 of the screw bit body 1 to position the ball-like shape terminally on the screw bit body 1. It is preferred that the curvature, length, and height of the concave surface 6 and the convex surface 5 is identical. The first lateral edge 3 and the second lateral edge 4 are positioned opposite to each other across the convex surface 5 and the concave surface 6, i.e. the bracing surface. When viewed from either the top perspective or the bottom perspective, the first lateral edge 3 and the second lateral edge 4 from each of the plurality of laterally-bracing sidewalls 2 make up the corners of the screw bit body 1. The engagement cavity 7 forms an additional gripping tooth for engaging the sidewalls of the socket fastener. More specifically, the engagement cavity 7 normally traverses into the convex surface 5 and the concave surface 6. Additionally, the engagement cavity 7 traverses into the screw bit body 1 from the first base 8 towards the second base 9 in order to create the additional gripping tooth all along the ball-like shape. Resultantly, the additional gripping tooth engages the socket fastener regardless of the angle between the socket fastener and the screw bit body 1.

Figure 5:
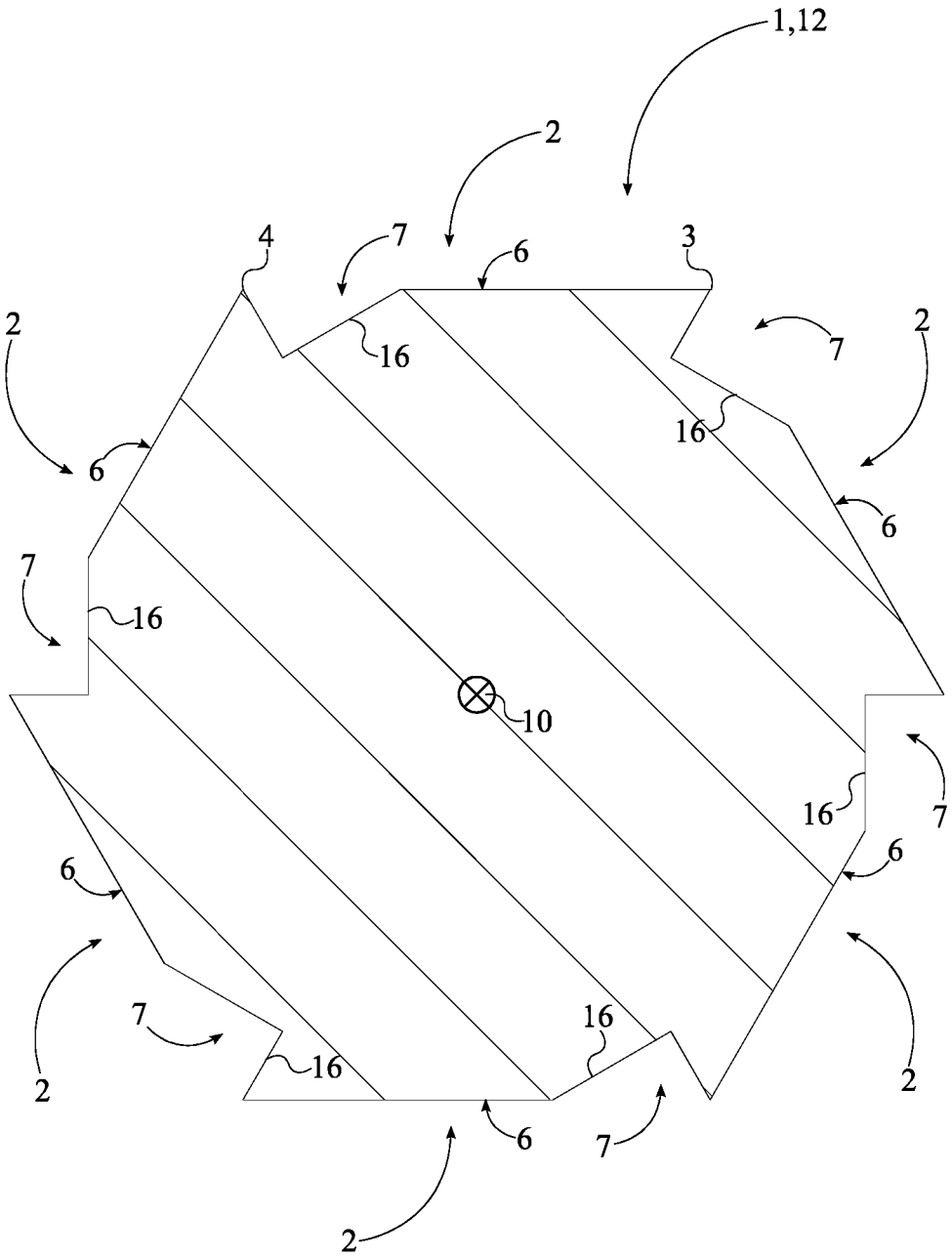
FIG. 5 is a cross-sectional view taken about line B-B in FIG. 3.

Referring to FIG. 4 and FIG. 5, more specifically, the additional gripping point for each of the plurality of laterally-bracing sidewalls 2 is created by the engagement cavity 7 and an adjacent edge, the edge closes to the engagement cavity 7 i.e. the first lateral edge 3. The distance between the engagement cavity 7 and the first lateral edge 3 defines the engagement point for the additional gripping tooth and is subject to change to meet various different types of fastener sizes and designs. In one embodiment of the present invention, the engagement cavity 7 tapers from the first base 8 to the second base 9 to decrease the number of sharp edges that the user might accidentally press and cut himself or herself on. It is preferred that a cross-section 16 of the engagement cavity 7 is a triangular profile. The triangular profile ensures that the engagement profile of the additional gripping tooth is sharp without compromising the structural integrity of the screw bit body 1. In alternative embodiments of the present invention, different profiles may be used for the engagement cavity 7 including, but not limited to, a semi-square profile, a semi-rectangular profile, and a semi-oval profile.

The present invention may be implemented as a tightening tool or an extraction tool. In general, the present invention may be implemented to apply torque in either a clockwise rotation or a counter-clockwise rotation. More specifically, the present invention may be implemented as a clockwise screw bit or a counter-clockwise screw bit. The clockwise screw bit version positions the engagement cavity 7 adjacent to the first lateral edge 3 such that the additional gripping tooth engages the sidewalls of the socket fastener when the screw bit body 1 is rotated in a clockwise direction, thus tightening the socket fastener. The counter-clockwise screw bit version positions the engagement cavity 7 adjacent to the second lateral edge 4 such that the additional gripping tooth engages the sidewalls of the socket fastener when the screw bit body 1 is rotated in a counter-clockwise direction, thus extracting the socket fastener. In general, the clockwise screw bit version and the counter-clockwise screw bit version are a mirror image of each other.

Figure 7:
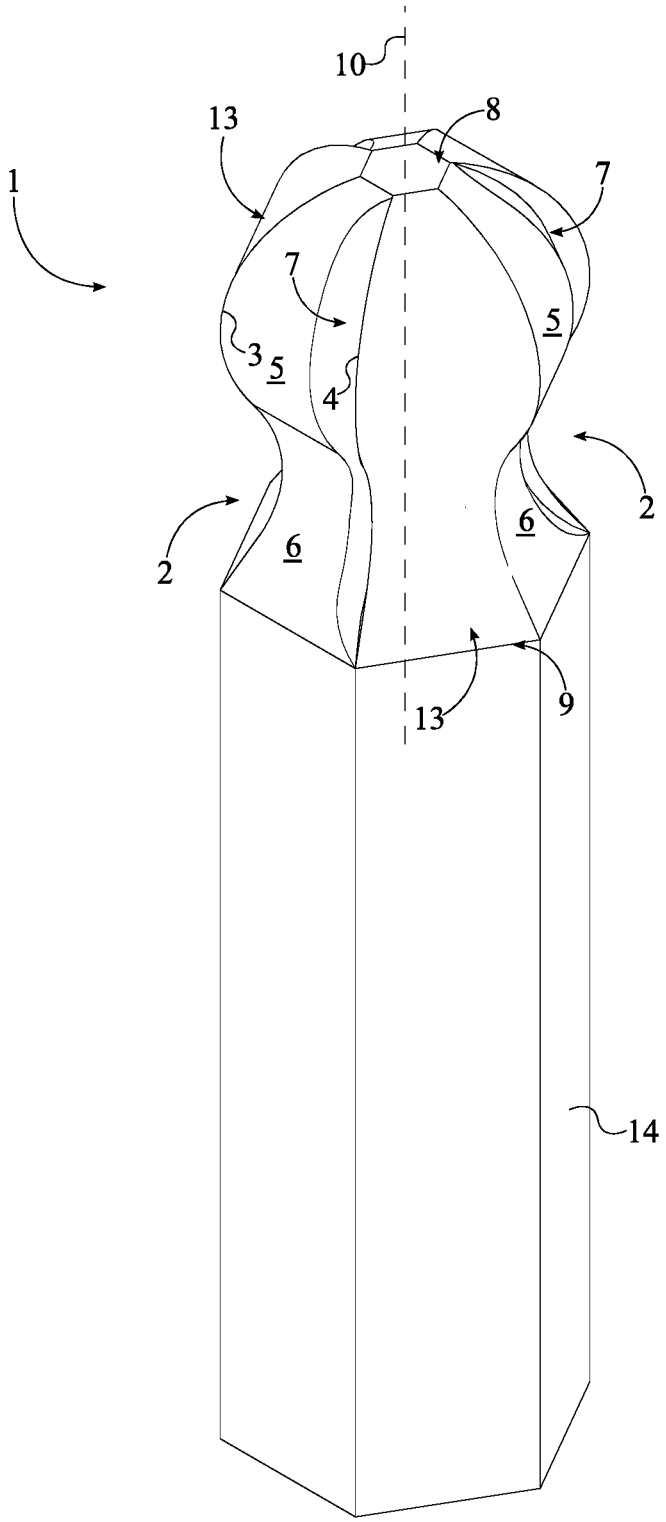
FIG. 7 is a perspective view of a further alternative embodiment of the present invention.

Referring to FIG. 7, the present invention may also further comprise a plurality of intermittent sidewalls 13. Each of the plurality of intermittent sidewalls 13 is a flat surface which engages the socket fastener like a traditional screw bit design. The plurality of intermittent sidewalls 13 is radially positioned about the rotation axis. Additionally, the plurality of intermittent sidewalls 13 is interspersed amongst the plurality of laterally-bracing sidewalls 2. Resultantly, the plurality of intermittent sidewalls 13 and the plurality of laterally-bracing sidewalls 2 radially alternate between each other.

The present invention also incorporates an attachment feature which allows an external torque tool to attach to the screw bit body 1 and transfer torque force onto the socket fastener through the screw bit body 1. Referring to FIG. 1, the present invention comprises an attachment body 14. The attachment body 14 is centrally positioned around and along the rotation axis 10 such that the rotation axis of the attachment body 14 and the rotation axis 10 of the screw bit body 1 are coincidentally aligned. Additionally, the attachment body 14 is connected adjacent to the second base 9. The attachment body 14 preferably has a hexagonal cross-section in order to fit within a female attachment member of the external torque tool. External torque tools include, but are not limited to, electric drills, torque wrenches, pneumatic drills, socket screw drivers, and other similar torque tools.

Figure 6:
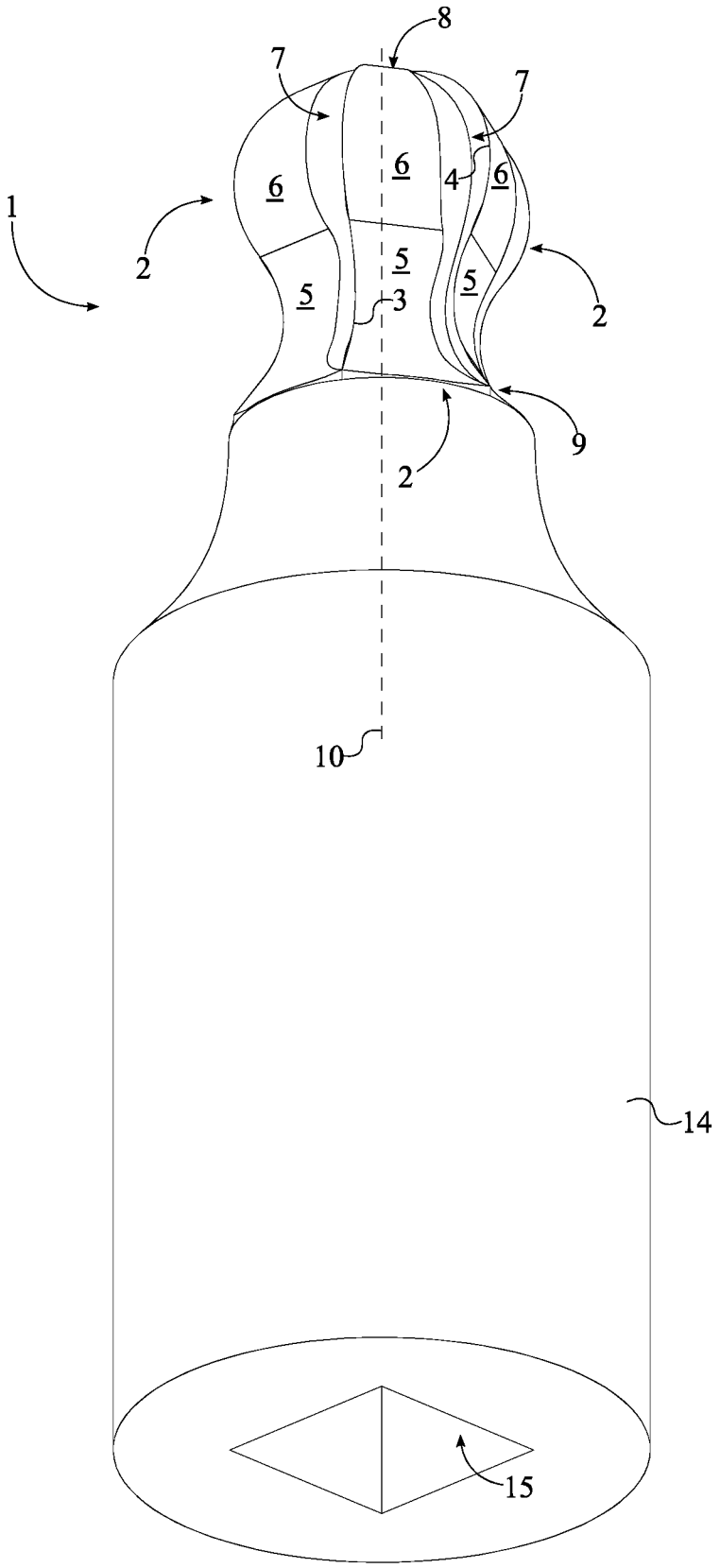
FIG. 6 is a bottom perspective view of a further alternative embodiment of the present invention.

In another embodiment, referring to FIG. 6, the present invention further comprises an engagement bore 15. The engagement bore 15 allows the present invention to be attached to a male attachment member of an external torque tool, such as a socket wrench or a screw driver. The engagement bore 15 traverses into the attachment body 14 along the rotation axis, opposite the screw bit body 1. The engagement bore 15 is shaped to receive a male attachment member of a socket wrench; the preferred shape is square as the majority of socket wrenches utilize a square attachment member. In this embodiment, the preferred attachment body 14 is cylindrical shaped. In alternative embodiments, the shape and design of the engagement bore 15 and the attachment body 14 may vary to be adaptable to different torque tool designs and different attachment means.

Figure 2:
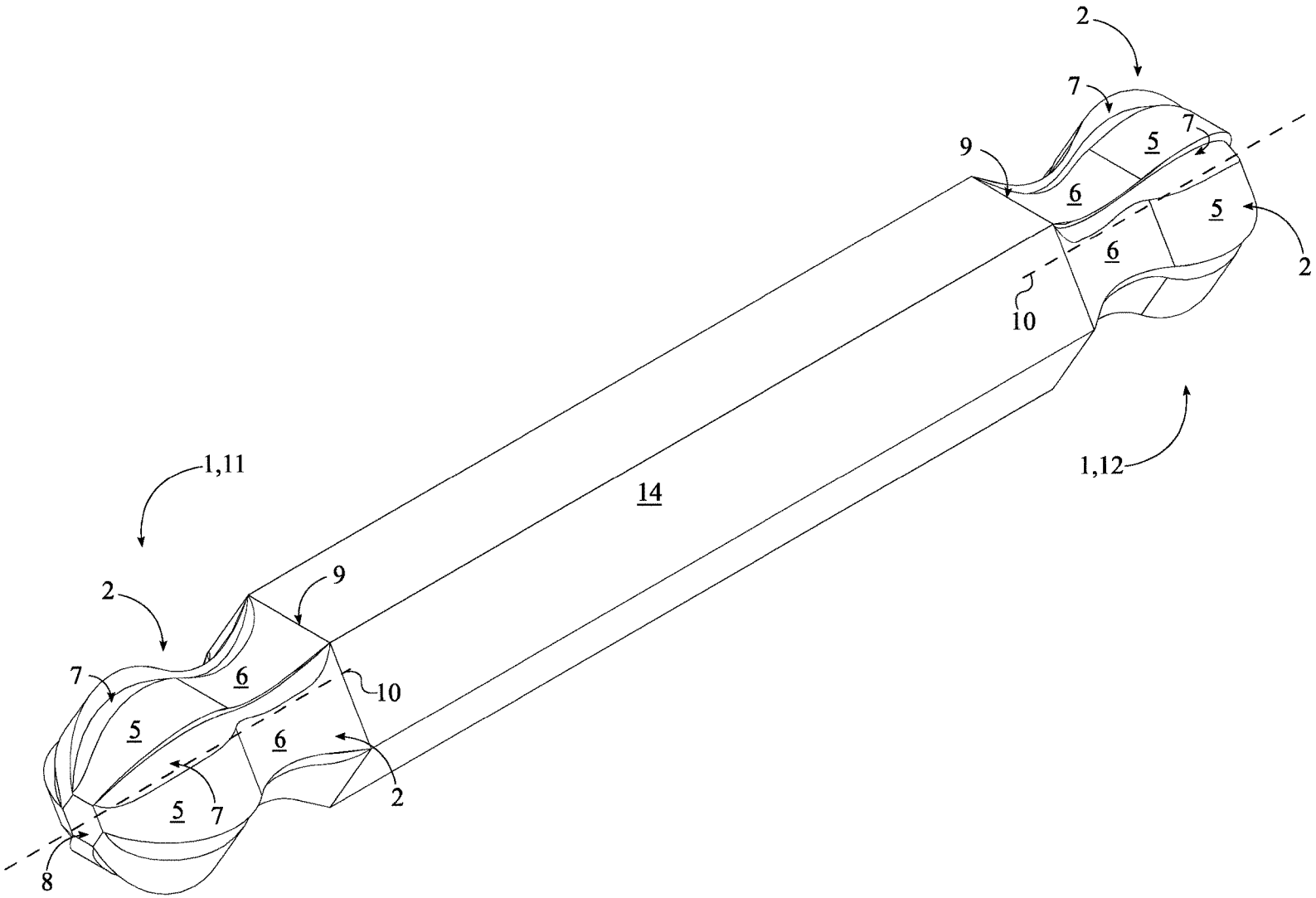
FIG. 2 is a perspective view of an alternative embodiment of the present invention.
Figure 3:
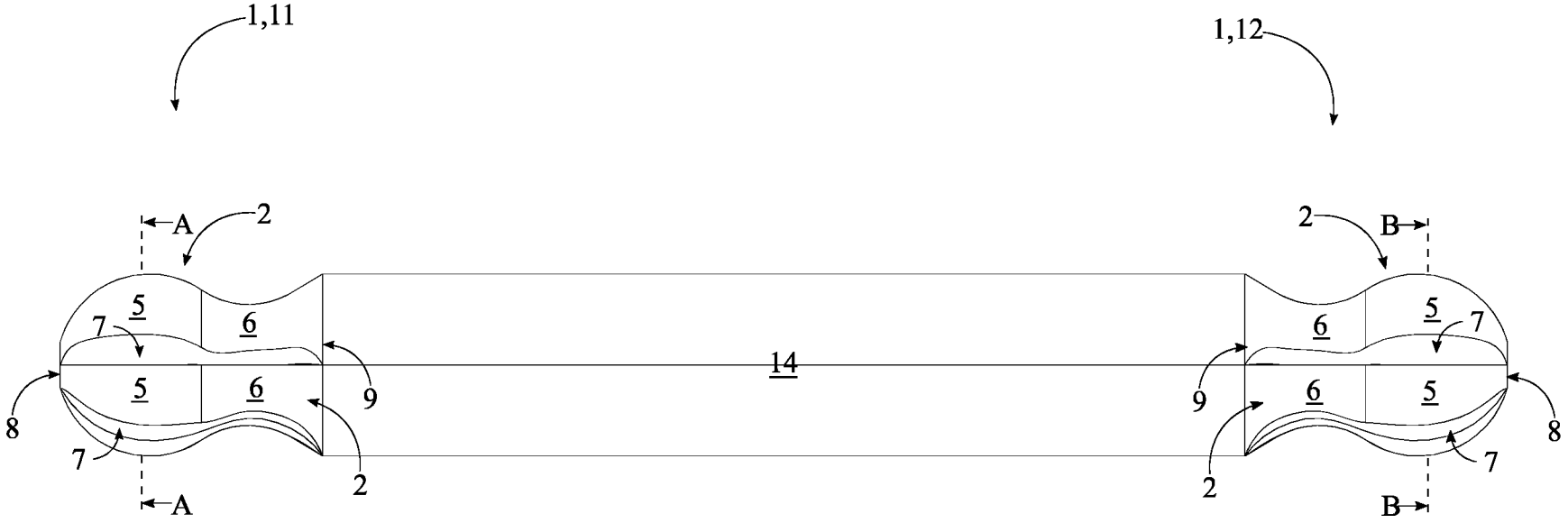
FIG. 3 is a side view of the alternative embodiment of the present invention.

In one embodiment, referring to FIG. 2 and FIG. 3, the present invention is implemented as a dual sided screw bit, thus providing both a clockwise and a counter-clockwise screw bit body 1 simultaneously. In this embodiment, the at least one screw bit body 1 comprises a first screw bit body 11 and a second screw bit body 12. The attachment body 14 preferably has a hexagonal cross-section. The attachment body 14 is centrally positioned around and along the rotation axis 10 of the first screw bit body 11 such that the rotation axis of the attachment body 14 and the rotation axis 10 of the first screw bit body 11 are coincidentally aligned. Additionally, the attachment body 14 is connected adjacent to the second base 9 of the first screw bit body 11. The second screw bit body 12 shares the attachment body 14 with the first screw bit body 11. Thus, the second screw bit body 12 is concentrically positioned with the first screw bit body 11. Additionally, the second screw bit body 12 is positioned adjacent to the attachment body 14, opposite the first screw bit body 11, similar to traditional double-sided screw bit designs. Similar to the first screw bit body 11, the attachment body 14 is connected to the second base 9 base of the second screw bit body 12. This embodiment yields the screw bit body 1 on either side of the attachment body 14. The first screw bit body 11 is designed to unscrew/extract a socket fastener, the counter-clockwise version, while the second screw bit body 12 is designed to screw a socket fastener, i.e. the clockwise version. For this, referring to FIG. 4, for each of the plurality of laterally-bracing sidewalls 2 of the first screw bit body 11, the engagement cavity 7 of the first screw bit body 11 is positioned adjacent to the first lateral edge 3 of the first screw bit body 11. The second screw bit body 12 is designed to unscrew/extract the socket fastener, i.e. the counter-clockwise version. Referring to FIG. 5, for each of the plurality of laterally-bracing sidewalls 2 of the second screw bit body 12, the engagement cavity 7 of the second screw bit body 12 is positioned adjacent to the second lateral edge 4 of the second screw bit body 12.

Although the invention has been explained in relation to its preferred embodiment, it is to be understood that many other possible modifications and variations can be made without departing from the spirit and scope of the invention as hereinafter claimed.

What is claimed is:

1. A spherical anti-slip fastener remover bit comprising:

a screw bit body;

the screw bit body comprising a plurality of laterally-bracing sidewalls, a first base and a second base;

each of the plurality of laterally-bracing sidewalls comprising a first lateral edge, a second lateral edge, a convex surface, a concave surface and an engagement cavity, the convex surface being positioned adjacent to the first base, the concave surface being positioned adjacent to the convex surface opposite to the first base, the convex surface and the concave surface being oriented along a rotation axis of the screw bit body, the first lateral edge and the second lateral edge being positioned opposite to each other across the convex surface and the concave surface, the engagement cavity normally traversing into the convex surface, the engagement cavity traversing into the screw bit body from the first base towards the second base, a cross-section of the engagement cavity being a triangular profile, the triangular profile extending from the first lateral edge towards the second lateral edge;

the first lateral edge of an arbitrary laterally-bracing sidewall among the plurality of laterally-bracing sidewalls being a sharp edge formed in between the engagement cavity of the arbitrary laterally-bracing sidewall among the plurality of laterally-bracing sidewalls and the convex surface of an adjacent laterally-bracing sidewall among the plurality of laterally-bracing sidewalls, or the first lateral edge of the arbitrary laterally-bracing sidewall among the plurality of laterally-bracing sidewalls being a sharp edge formed in between the engagement cavity of the adjacent laterally-bracing sidewall among the plurality of laterally-bracing sidewalls and the convex surface of the arbitrary laterally-bracing sidewall among the plurality of laterally-bracing sidewalls; and the plurality of laterally-bracing sidewalls being radially positioned about the rotation axis of the screw bit body.

2. The spherical anti-slip fastener remover bit as claimed in claim 1 comprising:

an attachment body;

an engagement bore;

the attachment body being centrally positioned around and along the rotation axis;

the attachment body being connected adjacent to the second base; and the engagement bore traversing into the attachment body along the rotation axis, opposite the screw bit body.

3. The spherical anti-slip fastener remover bit as claimed in claim 1 comprising:

an attachment body;

the attachment body being centrally positioned around and along the rotation axis; and the attachment body being connected adjacent to the second base.

4. The spherical anti-slip fastener remover bit as claimed in claim 1 comprising:

an attachment body;

the at least one screw bit body comprising a first screw bit body and a second screw bit body;

the attachment body being centrally positioned around and along the rotation axis of the first screw bit body;

the attachment body being connected adjacent to the second base of the first screw bit body;

the second screw bit body being concentrically positioned with the first screw bit body;

the second screw bit body being positioned adjacent to the attachment body, opposite the first screw bit body;

the attachment body being connected adjacent to the second base of the second screw bit body;

the engagement cavity of the first screw bit body being positioned adjacent to the first lateral edge; and the engagement cavity of the second screw bit body being positioned adjacent to the second later edge.

5. The spherical anti-slip fastener remover bit as claimed in claim 1 comprising:

the screw bit body further comprising a plurality of intermittent sidewalls;

the plurality of intermittent sidewalls being radially positioned about the rotation axis; and the plurality of intermittent sidewalls being interspersed amongst the plurality of laterally-bracing sidewalls.

6. The spherical anti-slip fastener remover bit as claimed in claim 1, wherein the engagement cavity tapers from the first base to the second base, and the engagement cavity reaches the first base and the second base.

* * * * *